US006983689B2

(12) United States Patent
Horn et al.

(10) Patent No.: US 6,983,689 B2
(45) Date of Patent: Jan. 10, 2006

(54) WEB-FED ROTARY PRESS

(75) Inventors: Matthias Willi Horn, Hofheim (DE); Klaus Georg Matthias Müller, Remlingen (DE)

(73) Assignee: Koenig & Bauer Aktienesellschaft, Wurzburg (DE)

( * ) Notice: Subject to any disclaimer, the term of this patent is extended or adjusted under 35 U.S.C. 154(b) by 46 days.

(21) Appl. No.: 10/470,741

(22) PCT Filed: Sep. 27, 2001

(86) PCT No.: PCT/DE01/03734

§ 371 (c)(1),
(2), (4) Date: Aug. 11, 2003

(87) PCT Pub. No.: WO02/064371

PCT Pub. Date: Aug. 22, 2002

(65) Prior Publication Data

US 2004/0089173 A1 May 13, 2004

(30) Foreign Application Priority Data

Feb. 9, 2001 (DE) ..... 101 05 926

(51) Int. Cl.
*B41F 7/10* (2006.01)

(52) U.S. Cl. ..... 101/180; 101/139; 101/182

(58) Field of Classification Search ..... 101/135–140, 101/178–182, 219–221
See application file for complete search history.

(56) References Cited

U.S. PATENT DOCUMENTS

| | | | | |
|---|---|---|---|---|
| 4,437,402 A | * | 3/1984 | Fischer | 101/181 |
| 5,699,735 A | | 12/1997 | Stein et al. | |
| 6,019,039 A | | 2/2000 | Knauer et al. | |
| 6,101,944 A | * | 8/2000 | Schmid et al. | 101/467 |
| 6,745,688 B1 | * | 6/2004 | Lemelin et al. | 101/138 |

FOREIGN PATENT DOCUMENTS

| | | | |
|---|---|---|---|
| DE | 43 03 904 A1 | | 8/1994 |
| DE | 0 710 558 A1 | | 5/1996 |
| DE | 196 03 663 A1 | | 8/1997 |
| DE | 43 03 904 C2 | | 9/1997 |
| EP | 0 710 558 B1 | | 8/1999 |
| EP | 947318 | * | 10/1999 |
| GB | 2 275 019 A | | 8/1994 |
| GB | 2 309 668 A | | 2/1997 |

* cited by examiner

*Primary Examiner*—Stephen R. Funk
(74) *Attorney, Agent, or Firm*—Jones Tullar & Cooper, PC

(57) ABSTRACT

A web-fed rotary printing press is used for printing a web and consists of at least two satellite cylinders and of at least six cylinders, each of which defines a printing location in cooperation with the satellite cylinders. Each printing location can be brought into a printing-on or a printing-off position. The six or more printing locations can be positioned to all print the same side of the web. At least five of the printing locations, that can be positioned on the same side of the web, are arranged in direct succession along the path of travel of the web.

6 Claims, 3 Drawing Sheets

WEB-FED ROTARY PRESS

Field of the Invention

The present invention is directed to a web-fed rotary printing press. The printing press includes a plurality of print locations that can all print the same side of a web.

Background of the Invention

A web-fed rotary printing press in satellite construction is known from EP 0 710 558 B1. Both sides of a paper web pass sequentially through 8 print positions. The web thus runs through 16 print positions. The web sequentially runs through the two printing towers in 4/4 paper guidance, and for the imprinting function the printing towers as a whole can each be placed against or away from the web.

DE 43 03 904 C2 shows an arrangement of two printing groups arranged on top of each other. A paper web running through the two printing groups can be imprinted on both sides in four colors at most.

SUMMARY OF THE INVENTION

The object of the present invention is directed to producing a web-fed rotary printing press.

In accordance with the present invention, this object is attained by providing a web-fed rotary printing press having at least two satellite cylinders and a plurality of cylinders which cooperate with them and define print positions. A plurality of colors of inks can be applied to the web, and specifically to one side of the web. Particular spacing distances between print positions facilitate proper printing of the web. Selected ones of the print positions can be operated in concert.

The advantages to be gained by the present invention reside, in particular, in that the two print positions which can be interchanged for imprinter operations, or for a flying printing forme change, which will be called "imprinter operations" in what follows, are placed not too far apart, and the free length of the paper web between these two printing groups is kept short. For example, in the case of a printing tower operating in satellite construction, the two interchangeable print positions are arranged within a printing tower having eight print positions.

It is of benefit to avoid a long paper path between the two interchangeable print positions, for example from one printing tower to the other. This long paper path avoidance generally improves the ability to maintain the register or the color register between two print positions. In contrast to alternatingly switching an entire printing tower on and off, more uniform conditions are provided on the processing path as a whole. For example, the dampening of the paper web is kept as uniform as possible by the use of the web-fed rotary printing press in accordance with the present invention. The situation is avoided because, in a first mode of operation of a so-called 4/4 +4/4 paper guidance, a first printing tower dampens the paper web and imprints it completely 4/4, while the second printing tower is turned off, and in a second mode of operation only the second printing tower imprints the paper web 4/4. Because of this, considerable differences exist between the running path of the dampened paper web between the two modes of operation. This is achieved, for example, by an 8/0 + 0/8 paper guidance, wherein its own printing tower with the complete imprinter functionality, is assigned to each of the obverse and reverse printing processes. The connected, as well as the corresponding disconnected printing group, are arranged in a common printing tower.

In every mode of operation during imprinter operations, at least one print position in each printing tower is advantageously in the print-on position.

Besides dampening by the use of dampening agents, other effects, for example the presence of clamping positions, the effects of print- related transverse or linear expansions, the effects because of the application of ink, or other parameters affecting the tension and the conveyance of the paper web, can be averaged out.

It is particularly of benefit that for all modes of operation during imprinter operations as uniform as possible conditions in the paper web exist. Therefore, as uniform as possible tension conditions in the paper web are produced.

The arrangement of the print positions, which are alternatingly printing the same color, close to one another, as well as the increased distance between the first and last simultaneously printing print position for both modes of operation, improve the print quality when changing from one mode of operation to the other mode of operations.

At least six successive print positions of a paper side have the same direction of rotation. For example, eight successive print positions of the printing tower can turn in the same direction, so that this paper side can be printed in four colors in the one printing tower in one imprinting operation, for example.

Paper paths in which, at a maximum, only four satellite cylinders or four counter-pressure cylinders "roll over" the fresh imprint are advantageous with respect to losses in quality. Such paper paths are also beneficial with respect to a reduction of the deposition of the fresh ink and the washing outlay connected therewith.

With the beneficial embodiment of the web-fed rotary printing press in a satellite construction, there is a good likelihood of keeping the register of two successive print positions because of the short distance between the two print positions, for example.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
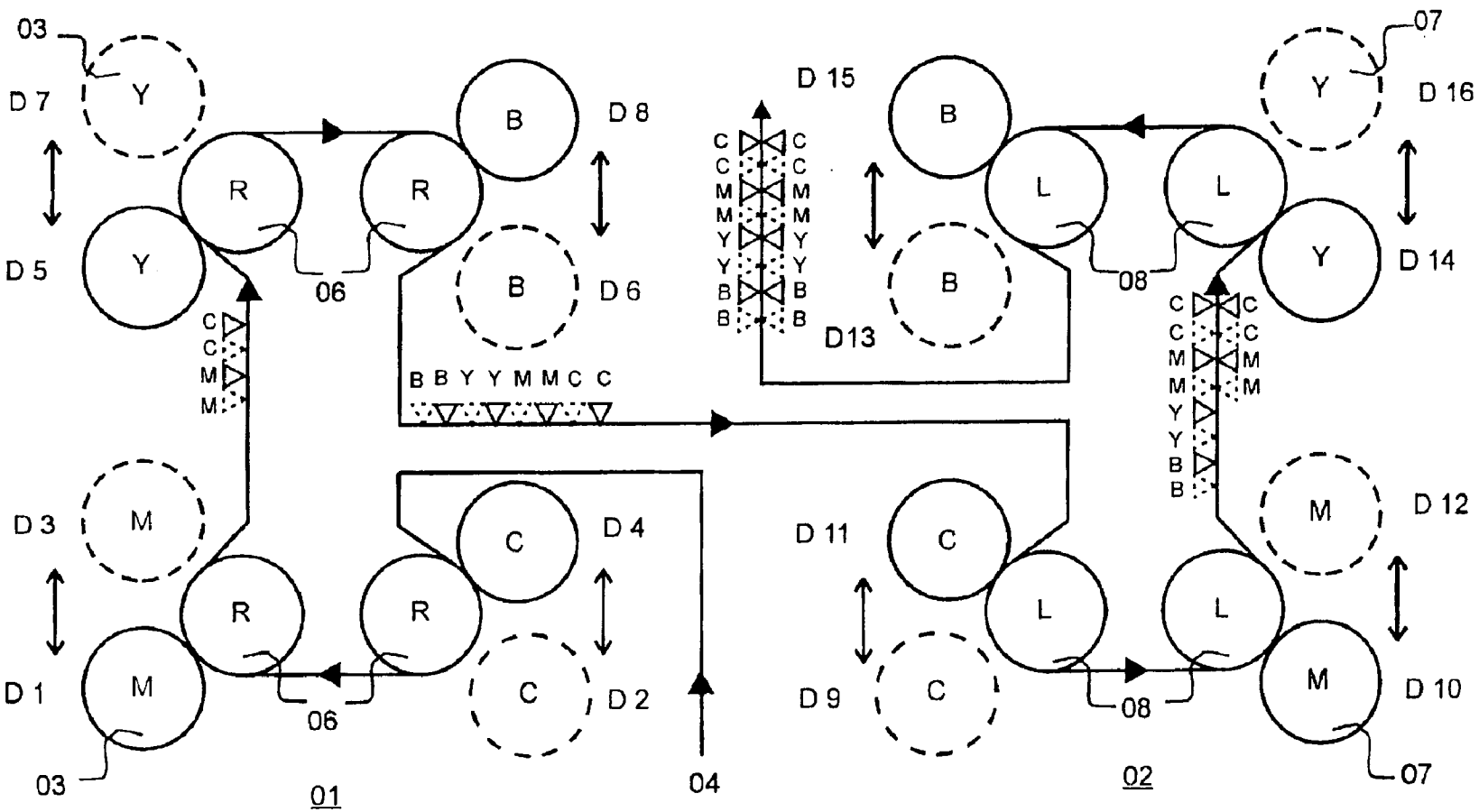
FIG. 1, a first preferred embodiment of a web-fed rotary printing press in accordance with the present invention and configured for complete imprinter functionality during four-color printing, in FIG. 2, a second preferred embodiment of a web-fed rotary press configured for complete imprinter functionality during four-color printing, and in FIG. 3, a third preferred embodiment of a web-fed rotary press configured for complete imprinter functionality during four-color printing.

Referring initially to FIG. 1, there may be seen a first preferred embodiment of a web-fed rotary press in accordance with the present invention. The printing press, which, in particular, is a web-fed rotary printing press, has a first printing unit 01, for example a first printing tower 01, and a second printing unit 02, for example a second printing tower 02. The first printing tower 01 has at least six print positions, and, in the example depicted in FIG. 1, has eight print positions, identified as positions D1, D2, D3, D4, D5, D65, D7, D8, which eight print positions are constituted by eight cylinders 03, for example eight transfer cylinders 03, and by four satellite cylinders 06, for example four steel cylinders 06, working together with them in a print-on position through a drawn-in web 04 of, for example, material to be imprinted, and in particular, a paper web 04. If the web-fed rotary printing press is designed for n-color printing, the first printing unit 01 has 2 n, or two times n print positions D1, D2, D3, D4, D5, D6, D7, D8 in order to provide complete imprinter functionality. For n-color printing on one side of the paper web 04 with an imprinter functionality of m colors ($m \leqq n$), the unit 01 has n+m print positions. In the example depicted in FIG. 1 for at least one-sided four-color printing with full imprinter functionality, two adjoining transfer cylinders 03 work together with each one of the four steel satellite cylinders 06 and form a total of eight print positions D1, D2, D3, D4, D5, D6, D7, D8. For example, this can be a pair of stacked ten-cylinder satellite units. However, four upper and/or four lower transfer cylinders 03 can also work together with a single satellite cylinder 06 as so-called nine-cylinder satellite units, which, for example are stacked.

The transfer cylinders 03 can be selectively placed into contact against, or can be moved out of contact or away from the respective satellite cylinder 06 with which they are associated, and work together with forme cylinders, that are not specifically represented, which forme cylinders in turn work together with ink systems, that are also not specifically represented, and, if required, with dampening units. For imprinter operations, at least this forme cylinder can be moved away from its associated one of the transfer cylinders 03 and can be operated at a speed of a number of revolutions which differs from at least those number of revolutions of the associated satellite cylinder 06, so that it can be braked, stopped, if required operated in the opposite direction or at a different number of revolutions, all independently of the satellite cylinder 06, for example for changing the printing forme or the print image. In the course of changing the printing forme or the print image, for example by image application on the forme cylinder, the satellite cylinder 06 and, if required the transfer cylinder 03, can continue to be operated at production rpm.

The second unit 02, for example the second printing tower 02, as depicted in FIG. 1, and having at least one, but preferably having four or eight further print positions D9, D10, D11, D12, D13, D14, D15, D16, is arranged upstream or downstream of the first printing tower 01 along the path of travel of the paper web 04. In a manner the same as the first printing tower 01, the second printing tower 02 has cylinders 07, for example transfer cylinders 07, which can be placed against satellite cylinders 08, for example steel cylinders 08.

In the first printing tower 01, the paper web 04 passes through the eight print positions D1, D2, D3, D4, D5, D6, D7, D8 in such a way that it loops around each satellite cylinder 06 in the same direction, in the embodiment depicted in FIG. 1 to the right R, i.e. in a clockwise direction, with respect to a conveying direction T of the paper web 04. All of the satellite cylinders 06 in the first printing tower 01 rotate in this direction. The paper web 04 can only be imprinted on its side facing the transfer cylinders 03, and can theoretically be imprinted eight times.

However, in this first printing tower 01, the paper web 04 is imprinted on this one side only four times in four colors in four of these eight print positions D1, D2, D3, D4, D5, D6, D7, D8, while the remaining four print positions D5, D6, D7, D8, D1, D2, D3, D4 can be refitted "on the fly", i.e. during production. The non-printing print positions D5, D6, D7, D8, D1, D2, D3, D4 use the same four colored inks as the printing ones.

In the first preferred embodiment shown in FIG. 1, the respective ones of the print positions D1, D2, D3, D4, D5, D6, D7, D8 with the same colored ink, which are assigned to each other and which are in the print-on and in the print-off position, with the print-off positions being represented in dashed lines and removed from the satellite cylinder, are arranged next to each other each and work together with the same satellite cylinder 06.

The two print positions D1, D3 adjoining to each other on the bottom left of the first printing tower 01 are each furnished with magenta M, the two print positions D2, D4 adjoining each other on the bottom right are furnished with cyan C, the two print positions D5, D7 adjoining each other on the top left are furnished with yellow Y, and the two print positions D6, D8 adjoining each other on the top right are furnished with black B.

Each of the two print positions D1, D2, D3, D4, D5, D6, D7, D8 with the same colored ink can be selectively placed against the associated satellite cylinder 06 so that, for example, the side of the paper web 04 facing the transfer cylinder 06 is printed in four colors by the printing groups D4, D1, D5 and D8 placed against it, while the printing groups D2, D3, D6 and D7 are moved away and can therefore be refitted, and vice versa. This selective use of each of the two transfer cylinders in each of the print positions is indicated by the two-headed arrow in FIG. 1.

The arrangement of pairs of print positions D2, D4; D1, D3; D5, D7; D6, D8 with the same colored ink is also possible in any other desired sequence within the first printing tower 01. The distance between the print positions D2, D4; D1, D3; D5, D7; D6, D8 with the same colored ink, which can be alternatingly put into contact, is reduced to a minimum, for example less than 1 m, which results in the minimization of any moisture problems which may possibly occur in the course of switching from one mode of operation to the other.

After the one-sided imprinting of the paper web in the first printing tower 01, the paper web 04 then passes through the second printing tower 02, as depicted in FIG. 1. Depending on the printing needs, the second printing tower or unit 02 has one or several, for example at least four, and in the example shown in FIG. 1 eight, print positions D9, D10, D1, D12, D13, D14, D15, D16, wherein the paper web 04 passes through the print positions D9, D10, D11, D12, D13, D14, D15, D16 in such a way that the side of the paper web 04 which had not been imprinted in the first printing tower 01 can be imprinted by the transfer cylinders 07 of the second printing tower 02. For this purpose, the satellite cylinders 08 of the second printing tower 02 all rotate in the same direction, in the first preferred embodiment shown in FIG. 1 in the direction of rotation toward the left L.

In the first preferred embodiment depicted in FIG. 1, the coverage with ink on the second side of web 04 is the same as that provided to web 04 in the printing tower 01, but is mirrored along the vertical direction. Again, for the purpose of imprinter functions, the transfer cylinders 07 can be placed against, or away from the associated satellite cylinders 08 alternatingly and in pairs.

Thus the paper web 04 is imprinted in the first printing tower 01 on one side, and in the second printing tower 02 on a second side and on both sides in four colors, with full imprinter functionality. The travel distance for moistening the paper web 04, in this case the travel distance between the printing groups D4 and D7, and between D2 and D5, is not changed, or is only insignificantly changed in comparison with the overall path or travel distance or length from the first printing group D4 to the last printing group D15 when a change is made from one mode of operation to the other mode of operation. The distance between the first and the last printing group which is in the print-on position, for example D4 to D15, or D2 to D13, is greater in both modes of operation than half the distance from the first to the last printing group D4 to D13 assigned to the paper web 04.

The location of moistening of the paper web 04 in particular is changed only insignificantly in the course of travel of web 04 through the printing press. This results in a more uniform web tension before and after the switching of printing modes. In this way, the danger of a web break between the printing units 01 and 02 during switch-over, as well as an increased control outlay, can therefore be reduced.

Figure 2:
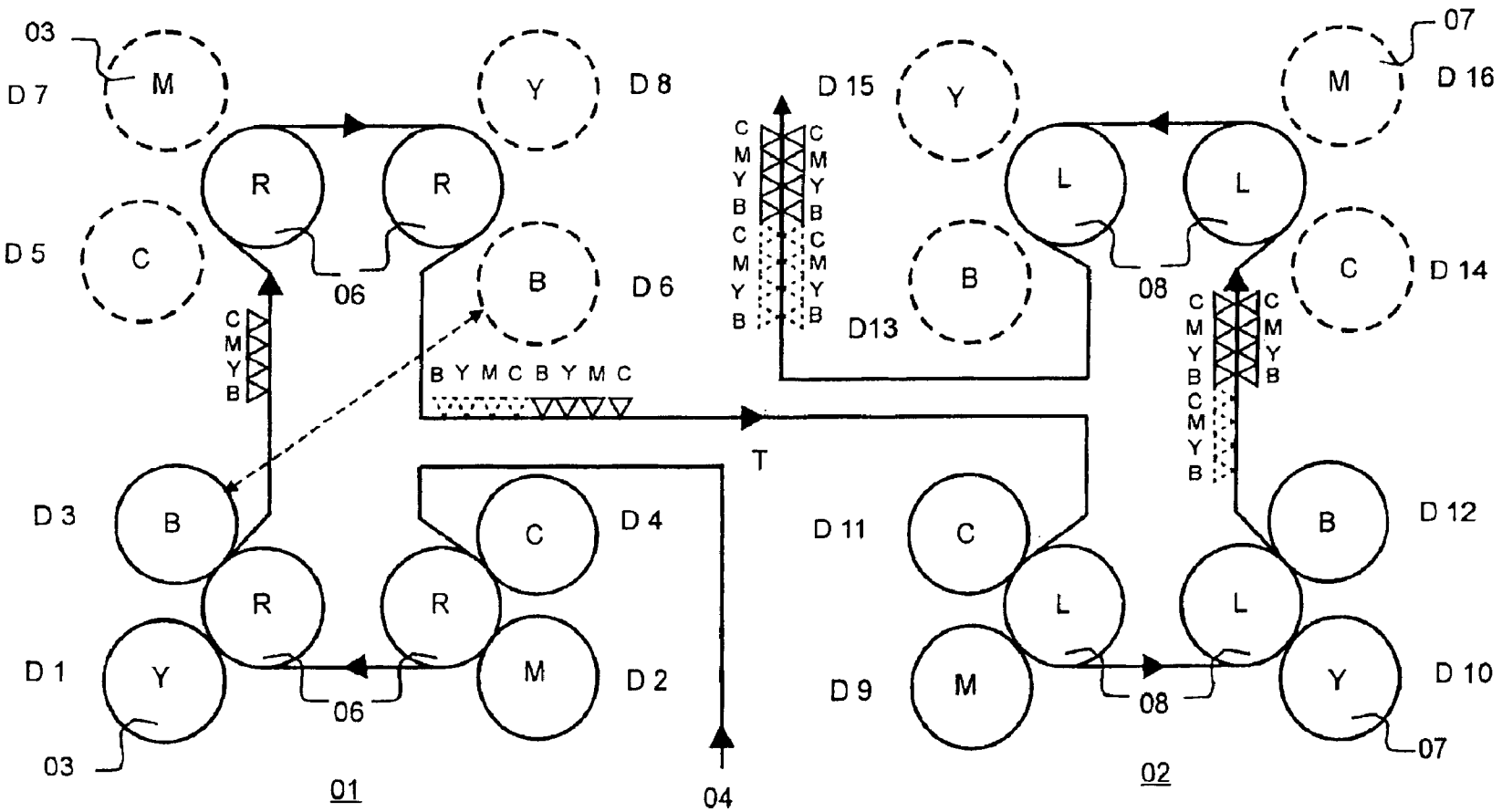

In the second preferred embodiment of the web-fed rotary printing press in accordance with the present invention, as seen in FIG. 2, the paper web 04 passes around the satellite cylinder 06 of the first printing tower 01 in the same direction, i.e. to the right R, and can be imprinted on one side by all eight print positions D1, D2, D3, D4, D5, D6, D7, D8. The same applies to the guidance of the paper web 04, however now to the left L, and the print positions D9, D10, D11, D12, D13, D14, D15, D16 in the second printing tower 02.

However, in this second preferred embodiment the two print positions D1, D2, D3, D4, D5, D6, D7, D8, D9, D10, D11, D12, D13, D14, D15, D16, respectively which are provided with the same colored ink in each printing tower 01, 02, and which can be alternatingly placed into and out of operation, are not arranged directly adjoining and working together with the same satellite cylinder 06, 08 as was the case in the first embodiment. Instead, they are arranged, within their respective printing tower 01 or 02, in a diagonally mirror-like way which is indicated in FIG. 2 by the use of a dashed arrow, as seen in the first printing unit unit 01. In the depicted second preferred embodiment, the print positions D1 and D8 in the first printing tower 01, and the print positions D10 and D15 in the second printing tower 02 contain the color yellow Y. The print positions D2 and D7 in the first printing tower 01 and the print positions D9 and D16 in the second printing tower 02 contain the color magenta M. The print positions D3 and D6 in the first printing tower 01 and the print positions D12 and D13 in the second printing tower 02 contain the color black B. The print positions D4 and D5 in the first printing tower 01 and the print positions D11 and D14 in the second printing tower 02 contain the color cyan C.

A mode of operation is advantageous with this second preferred embodiment in which, in one state of operation the four print positions D1, D2, D3, D4,; D9, D10, D11, and D12 respectively, which are arranged on the bottom of the first printing tower 01 and the second printing tower 02, are in the print-on position, while the upper print positions D5, D6, D7, D8; D13, D14, D15, D16 of the first and second towers 01 and 02 respectively are accessible for refitting, and vice versa. Therefore the respective ones of the print positions D1, D2, D3, D4, D5, D6, D7, D8, D9, D10, D11, D12, D13, D14, D15, D16 which are to be refitted are all located effectively on one level, or on one service level of the printing press.

The ones of the printing groups D1, D2, D3, D4, D5, D6, D7, D8, D9, D10, D11, D12, D13, D14, D15, D16 which are provided with one colored ink, and which alternatingly work together with the same side of the paper web 04, are respectively located within a printing unit 01, 02. The maximum distance between these two printing groups D1, D2, D3, D4, D5, D6, D7, D8, D9, D10, D11, D12, D13, D14, D15, D16 in each printing unit is therefore less than half the length of the path of travel of the paper web 04 from the first to the last print position D4, D2, D1, D3, D5, D7, D8, D6, D11, D9, D10, D12, D14, D16, D15, D13. The distribution of moisture is more uniform for both modes of operation than if the paper web 04 were imprinted once only by use of the first print unit 01, and the other time only by the use of the other or second print unit 02 in 4/4 operations. The distance between the first and the last of the printing group D4 and D12, or D5 of the printing group and D13, which are in the contacted position, is greater in both modes of operation of the imprinter operation than half the distance between the first and the last printing group D4, D2, D1, D3, D5, D7, D8, D6, D11 D9, D10, D12, D14, D16, D15, D13, for example D4 and D13. It is beneficial that in both modes of operation, at least one of the printing groups D1, D2, D3, D4, D5, D6, D7, D8, D9, D10, D11, D12, D13, D14, D15, D16 is in the contact position and therefore moistens the paper web 04.

Figure 3:
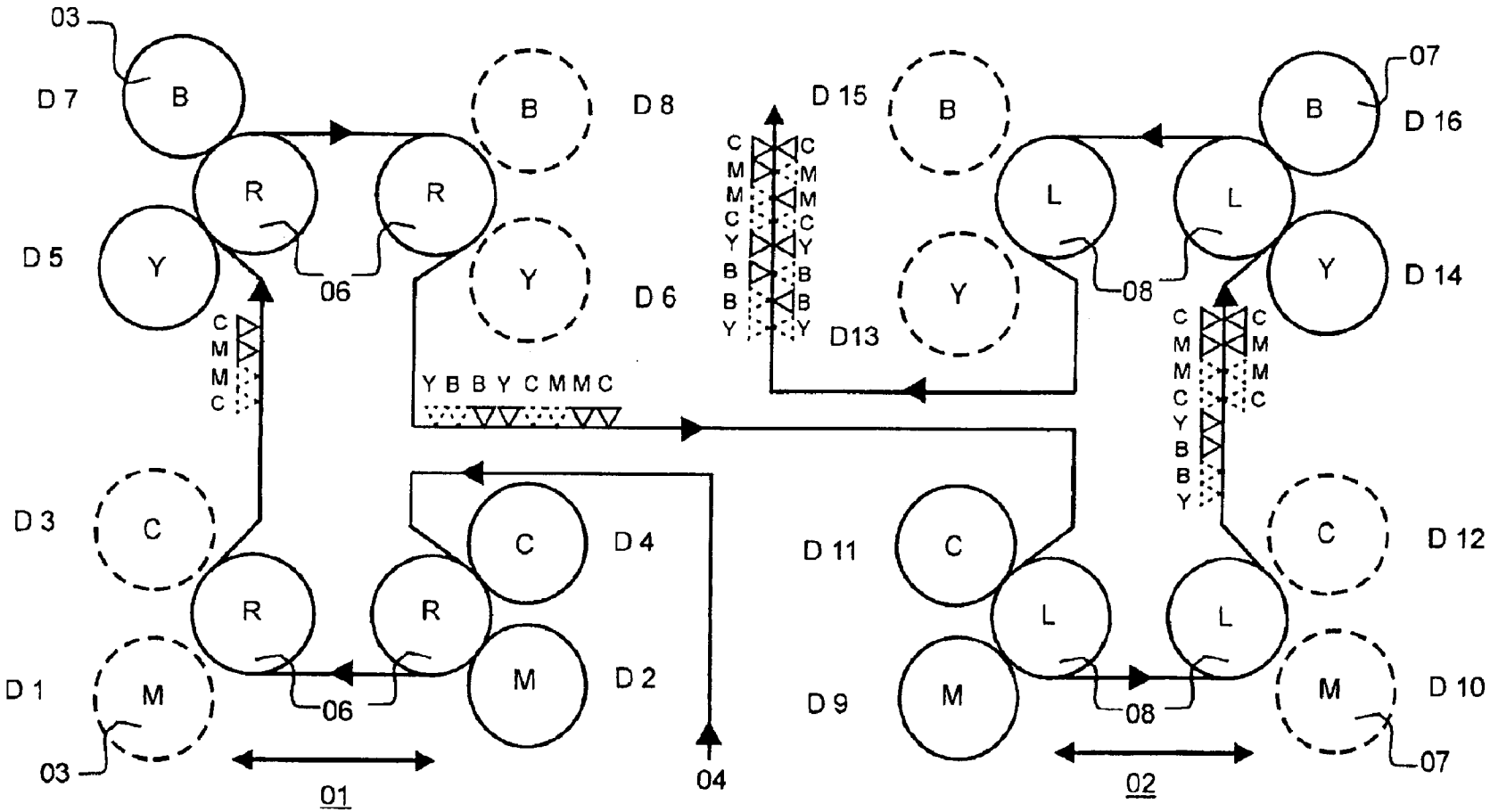

In the third preferred embodiment depicted in FIG. 3, the paper web 04 passes around the satellite cylinders 06 of the first printing tower 01 and around the satellite cylinders 08 of the second printing tower 02 in the same direction, for example to the right R in the first printing tower 01 and to the left L in the second printing tower 02.

However, the two of the print positions D1, D2, D3, D4, D5, D6, D7, D8, D9, D10, D11, D12, D13, D14, D15, D16, which are provided with the same colored ink in each printing tower 01, 02, and which can be alternatingly placed into and out of operation, are each arranged within their respective printing tower 01, 02 in a mirror image position with respect to a vertical line. In the third preferred embodiment shown in FIG. 3, the print positions D1 and D2 in the first printing tower 01, and the print positions D9 and D10 in the second printing tower 02 contain the color magenta M. The print positions D3 and D4 in the first printing tower 01 and the print positions D11 and D12 in the second printing tower 02 contain the color cyan C. The print positions D5 and D6 in the first printing tower 01 and the print positions D13 and D14 in the second printing tower 02 contain the color yellow Y. The print positions D7 and D8 in the first printing tower 01 and the print positions D15 and D16 in the second printing tower 02 contain the color black B.

One particularly advantageous mode of operation is wherein in one state the print positions D2, D4, D5, D7, D9, D11, D14, D16 which are located diagonally opposite each other inside each of the respective printing tower 01, 02 are in the print-on position, while the other diagonally oppositely located print positions D1, D3, D6, D8, D10, D12, D13, D15 are accessible for refitting and vice versa. The print positions such as D1, D3, D6, D8, D1O, D12, D13, D15 to be refitted are not located directly adjoining the print positions D2, D4, D5, D7, D9, D11, D14, D16 or D1, D3, D6, D8, D10, D12, D13, D15 on which the production runs. This mode of operation makes fewer demands on safety precautions.

In this preferred embodiment, the printing groups D1, D2, D3, D4, D5, D6, D7, D8, D9, D10, D11, D12, D13, D14, D15, D16, each with one colored ink, and which alternatingly work together with the same side of the paper web 04, are respectively located within a unit 01 or 02. The maximum distance between these two printing groups D1, D2, D3, D4, D5, D6, D7, D8, D9, D10, D11, D12, D13, D14, D15, D16 is less than half the length of the paper web 04 from the first to the last print position D4, D2, D1, D3, D5, D7, D8, D6, D11, D9, D10, D12, D14, D16, D15, D13. The local distribution of moisture is uniform for both modes of operation. Also in the third embodiment, the distance between the first and the last of the printing groups, for example D4 and D16, or D1 and D13, which are in the contacted position, is greater in both modes of operation of the imprinter operation than half the distance between the first and the last printing groups D4, D2, D1, D3, D5, D7, D8, D6, D11, D9, D10, D12, D14, D16, D15, D13, for example D4 and D13.

It is beneficial that in both modes of operation at least one of the printing groups D1, D2, D3, D4, D5, D6, D7, D8, D9, D10, D11, D12, D13, D14, D15, D16 is always in a contacted position and therefore moistens the paper web 04.

If a production with full imprinter functionality, which differs from a four-color print on both web sides, is desired, other configurations of the first unit 01 and of the second unit 02 are also conceivable. If, for example, this requirement of four-color print with full imprinted functionality must be met for only one side of the paper web 04, and with only a four-color imprint without imprinter functionality, or a two-color imprint with full imprinter functionality requirement on the other side of the web, the second unit 02 can be reduced to four print positions D9, D10, D11, D12. Alternatively, the other print positions D13, D14, D15, D16 of a second unit 02, which is a printing tower 02, can work together with a second paper web, that is not specifically represented, from a printing tower, which is also not specifically represented, and which corresponds to the first printing tower 01.

It is also possible to equip at least one of the units 01, 02 for printing using more than four colored inks, for example for n=6 colored inks with, for example, two-color imprinter capability, m=2, on one side of the paper web 04, so that this unit 01, 02 has eight print positions, through all of which print positions the web 04 runs in the same direction of rotation. The same applies correspondingly to the requirement of less than four colored inks, for example three colored inks with six print positions D1, D2, D3, D4, D5, D6, with full imprinter functionality.

For every configuration of the units or printing towers 01, 02 it is advantageous if the two print positions D4, D2; D1, D3; D5, D7; D8, D6; D11, D9; D10, D12; D14, D16; D15; D13 which correspond or which can be alternatingly placed against a side of the paper web, have a distance which is short, and in particular is less than half the length of the paper path between the first and the last print position D4, D2, D1, D3, D5, D7, D8, D6, D11, D9, D10, D12, D14, D16, D15, D13, working together with the paper web 04. However, the area of moistening, i.e. the length of the paper web 04 between the first and last contacting print position D4, D2, D1, D3, D5, D7, D8, D6, D11, D9, D10, D12, D14, D16, D15, D13, D1, must be greater than half the above mentioned length in each one of the two operating situations.

If the printing groups D1, D2, D3, D4, D5, D6, D7, D8, D9, D10, D11, D12, D13, D14, D15, D16 for both sides of the paper web 04 are arranged in two different, for example are arranged in two structurally separate, units 01, 02, at least one print position D1, D2, D3, D4, D5, D6, D7, D8, D9, D10, D11, D12, D13, D14, D15, D16 must be in the contacting position in each unit 01, 02 in each one of the two operating situations. In this case, it is advantageous if one unit 01, 02 is assigned to the respective obverse and reverse printing process. The guidance of the paper web 04 around the satellite cylinder 06, 08 inside the respective units 01, 02 can then take place in the same direction.

It is furthermore beneficial if first all n colored inks, whether n=3, 4, 5, 6, and in the examples n= four colored inks Y, B, M, C are applied to one side of the web 04 before the other side of the web is imprinted.

In a further development of the web-fed rotary press in accordance with the present invention, but which is not specifically represented, several printing groups with respective pairs with the same colored ink B, C, M, Y, can be arranged in a bridge construction, and thus in a rubber-against-rubber operation, wherein four such printing groups, which imprint the same side of the paper web 04, are embodied in two colors, for example. These printing groups with the same colored ink are preferably arranged respectively next to each other in the running direction of the paper web. Since printing and non-printing printing groups are not completely spatially separated in the running direction of the paper web 04, but are arranged in an alternating manner, for example, it is advantageous that here, too, an averaging out of the conditions occurs in the course of a change from the one to the other mode of operation during imprinter operations.

In the same way, the preferred embodiments discussed above can be applied to an imprinter operation wherein no alternating printing, in the sense of a flying plate change, for example for printing different regional versions of a newspaper is intended. Instead, the insertion of an additional printed image, such as added text, decorative color, is desired. In this case, the print position printing group which, for example, is only activated at certain times, should be arranged near print positions that are printing on the same side of the web, and should be located in a particularly advantageous manner directly next to them. In the sense of averaging out the conditions on the web 04, when employing several such print positions for use on one side of the web 04, it is desirable not to arrange them together upstream of the first or downstream of the last "normal" printing group.

While preferred embodiments of a web-fed rotary press in accordance with the present invention have been set forth fully and completely hereinabove, it will be apparent to one of skill in the art that various changes in, for example the drives for the print positions, the specific types of inking units used to provide the inks, the specific forme cylinder constructions, and the like could be made without departing from the true spirit and scope of the present invention which is accordingly to the limited only by the following claims.

What is claimed is:

1. A web-fed rotary printing press adapted for printing a web comprising:

a first printing tower adapted to print a first side of a web;

at least first and second satellite cylinders in said first printing tower and being rotatable in a first direction;

a first group of at least six cylinders in said first printing tower and defining a first printing unit adapted to apply ink to a first side of said web, said first printing unit have a plurality of possible first print positions with said at least first and second satellite cylinders in said first printing tower, at least two of said possible first print positions being alternatingly actuatable for application, in a print-on position of each of said at least two of said possible first print positions, of the same colored ink to said first side of said web wherein, in a first operating mode, a first half of said first possible print positions in said first printing unit are in a print-on position and in a second operating mode a second half of said first possible print positions in said first printing unit are in a print-on position;

a second printing tower adapted to print a second side of said web;

at least third and fourth satellite cylinders in said second printing tower and being rotatable in a second direction opposite to said first direction;

a second group of at least six cylinders in said second printing tower and defining a second printing unit adapted to apply ink to a second side of said web, said second printing unit having a plurality of possible second print positions with said at least third and fourth satellite cylinders in said second printing tower, at least two of said possible second print positions being alternatingly actuatable for application, in a print-on position of each of said at least two of said possible second print positions, of the same colored ink to said second side of said web;

a first distance along a path of web travel through said first and second printing towers between a first one of said possible first print positions and a last one of said possible second print positions which are simultaneously in said print-on position; and a second distance of a length of said path of web travel through said first and second printing towers between a first one of said possible first print positions and a last of said possible second print positions assigned to the web, said first distance being greater than half said second distance.

2. The web-fed rotary printing press of claim 1 further including six possible first and second print positions and wherein at least five of said six possible first and second print positions which each apply ink on the same side of said web in said print-on position are arranged in direct sequence on said path of web travel.

3. The web-fed rotary printing press of claim 1 wherein a maximum distance between said two of said possible print positions for application in a print-on position of the same colored ink to one side of the web is less than half said second distance.

4. The web-fed rotary printing press of claim 1 wherein said first side of said web is printed only in said first printing tower and said second side of said web is printed only in said second printing tower.

5. The web-fed rotary printing press of claim 1 wherein each of said first and second printing towers is a ten-cylinder satellite unit each having two satellite cylinders and eight transfer cylinders.

6. A web-fed rotary printing press adapted for printing a web comprising:

at least eight possible print positions adapted, in a print-on position, to apply colored inks to a web passing through said at least eight possible print positions along a path of web travel; and means supplying a same one of said colored inks to pairs of said at least eight possible print positions wherein, in said print-on position, same ones of said colored inks can be applied alternatingly to the same side of a web and wherein, in a first operating mode, a first four of said print positions along said path of web travel are arranged to apply said colored inks to a side of a web, and in a second operating mode a next four of said print positions along said path of web travel are arranged to apply said colored inks to a side of a web.

* * * * *